United States Patent [19]

Banzoli et al.

[11] 4,337,829

[45] Jul. 6, 1982

[54] CONTROL SYSTEM FOR SUBSEA WELL-HEADS

[75] Inventors: Valeriano Banzoli, Mestre; Leonardo Beccegato, Venice; Paolo Minardi; Emilio Morganti, both of Mestre; Marco P. Selleroni, Venezia-Lido, all of Italy

[73] Assignee: Tecnomare, S.p.A., Venice, Italy

[21] Appl. No.: 171,328

[22] Filed: Jul. 23, 1980

Related U.S. Application Data

[63] Continuation-in-part of Ser. No. 27,452, Apr. 5, 1979, abandoned, which is a continuation of Ser. No. 892,198, Mar. 31, 1978, abandoned.

[51] Int. Cl.[3] ..... E21B 34/04

[52] U.S. Cl. ..... 166/366; 166/362; 166/363; 137/236 S

[58] Field of Search ..... 166/338, 339, 362–368; 137/236, 236 S

[56] References Cited

U.S. PATENT DOCUMENTS

| | | | |
|---|---|---|---|
| 3,405,387 | 10/1968 | Koomey et al. | 166/368 X |
| 3,894,560 | 7/1975 | Baugh | 166/368 X |
| 4,095,421 | 6/1978 | Silcox | 137/236 X |
| 4,174,000 | 11/1979 | Milberger | 166/362 |

*Primary Examiner*—Ernest R. Purser

*Attorney, Agent, or Firm*—Morgan, Finnegan, Pine, Foley & Lee

[57] ABSTRACT

A control system for subsea oil wells, more particularly well heads, is disclosed, which comprises, in combination, an electronic command and control unit, a valve actuating hydraulic electric unit, a power generator unit, and interconnection devices for interconnecting the hydraulic lines for controlling the whole system from the surface with the hydraulic units for commanding the electric-hydraulic unit.

9 Claims, 4 Drawing Figures

CONTROL SYSTEM FOR SUBSEA WELL-HEADS

BACKGROUND OF THE INVENTION

This application is a continuation-in-part of U.S. patent application Ser. No. 27,452 filed April 5, 1979, now abandoned, which is a continuation of U.S. patent application Ser. No. 892,198 filed March 31, 1978, now abandoned.

This invention relates to a control system for subsea well-heads adapted to control subsea oil wells in deep waters (down to about 600 meters of water depth). A number of systems are known for operating oil wells on the sea bottom, but none of these combines all the features and capabilities of the system according to the present invention. The prior art includes U.S. Pat. No. 3,405,387 to Koomey et al which discloses merely an accoustical control system rather than the various transmission systems possible with the present invention such as cable, pipe or accoustical coupling. Furthermore, this system is designed to check simultaneously a number of well heads from a single console whereas the Koomey patent refers to a single well head. Finally, the container and the hydraulic system of the invention are radically different from the Koomey arrangement.

Another patent of interest is U.S. Pat. No. 3,894,560 to B. F. Baugh which discloses a sub-sea control network including a multiple pressure responsive sequence valve mounted in a single hydraulic control line providing direct control to the valves of the underwater installation under emergency conditions. The patent fails to disclose a unique control system having multiple transmission capabilities.

The well-head control system according to the present invention does not require, for its erection and operation the services of frog-men. It is remotely controlled both acoustically and by cable and also electrically along the flow lines for the hydrocarbons. It is supplied with electricity by a subsea radio-isotope generator. Mechanically, the underwater control arrangement is mounted in a modular pattern. The lower portion of the container within which the system is mounted comprises the components which are intended to stay on the sea bottom for long periods of time, the top portion includes those components which require occasional upkeep. The top portion also contains all components of the control system proper.

The well-head, since the control and feed system are integrated thereon, does not require any connection with the terminal platform, the only exception being the flow lines for the hydrocarbons. As a result, all the problems associated with conventional arrangements which involve the use of subsea electric cables and connectors are overcome.

SUMMARY OF THE INVENTION

A control system for subsea oil wells or more specifically, an underwater automated well head system, comprises an above-water control console and a modular underwater control unit coupled thereto acoustically, by electric cable and by flow lines. The underwater control module comprises an electronic unit containing the control circuitry, an electro-hydraulic unit for operating the well head valves and a hydraulic-electronic electrical interface. A power generator is also included within the underwater control module. The electro-hydraulic unit is coupled to a submerged Christmas tree in a manner that it is able to control up to 15 well heads each having up to 7 well head valves and to obtain up to 7 data inputs such as pressure, temperature etc. Advantageously, the entire system can be remotely controlled from the surface by selected transmission links.

In operation, the control signals for the well-head are transmitted, after suitable codification, from the surface control console to the underwater electronics unit using one of the three transmission links. The signals after decodification are sent through the electrical interface to the hydraulic unit which operates the well-head valves.

Accordingly, the object of this invention is to provide a new and improved control system for subsea well-heads.

BRIEF DESCRIPTION OF THE DRAWINGS

Other objects and advantages of the present invention may be more clearly seen when viewed in conjunction with the following drawings wherein.

DETAILED DESCRIPTION OF THE INVENTION

Figure 1:
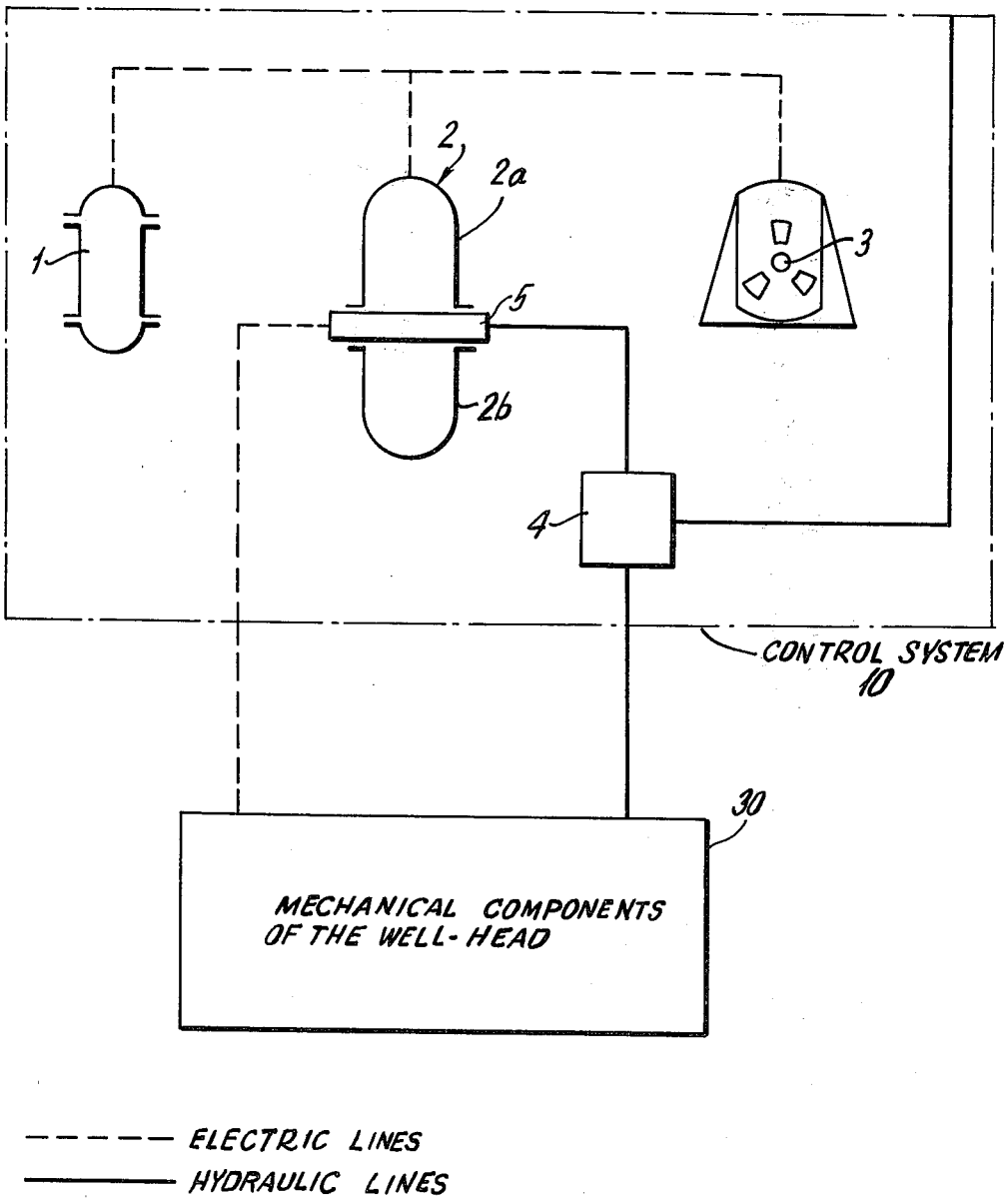
FIG. 1 is a schematic drawing of the well-head control system showing the basic components thereof and the electric and hydraulic control lines.

In describing in detail the well-head control system 10, reference will be had to the accompanying drawings which show diagrammatically a practical embodiment of the subject system, given by way of example only and without limitation. It is, of course, possible to introduce a number of modifications and changes without departing from the scope and the function of this invention.

The well-head control system is principally composed of a container 1 for the control electronic circuitry 15 connected to the hydrophones 12 and to the transmitting station 18 for receiving and sending the acoustic signals from the control unit 20. The electronic circuitry is also adapted to operate by using an electric cable 13 and the subsea conduits 14 as means for transmitting the necessary signals. The electronic circuitry encodes and decodes the signals, starting signals and arriving signals, from and to the mechanical components of the well head 30.

The electronic circuitry is adapted to operate, with the intermediary of the electric-hydraulic installation and the cutoff valves 4 for the well in sending analogic data (readings of pressure, electric voltage and others), indications relative to the position of the cutoff valves 4 of the well and possible conditions of block and alarm.

Figure 3:
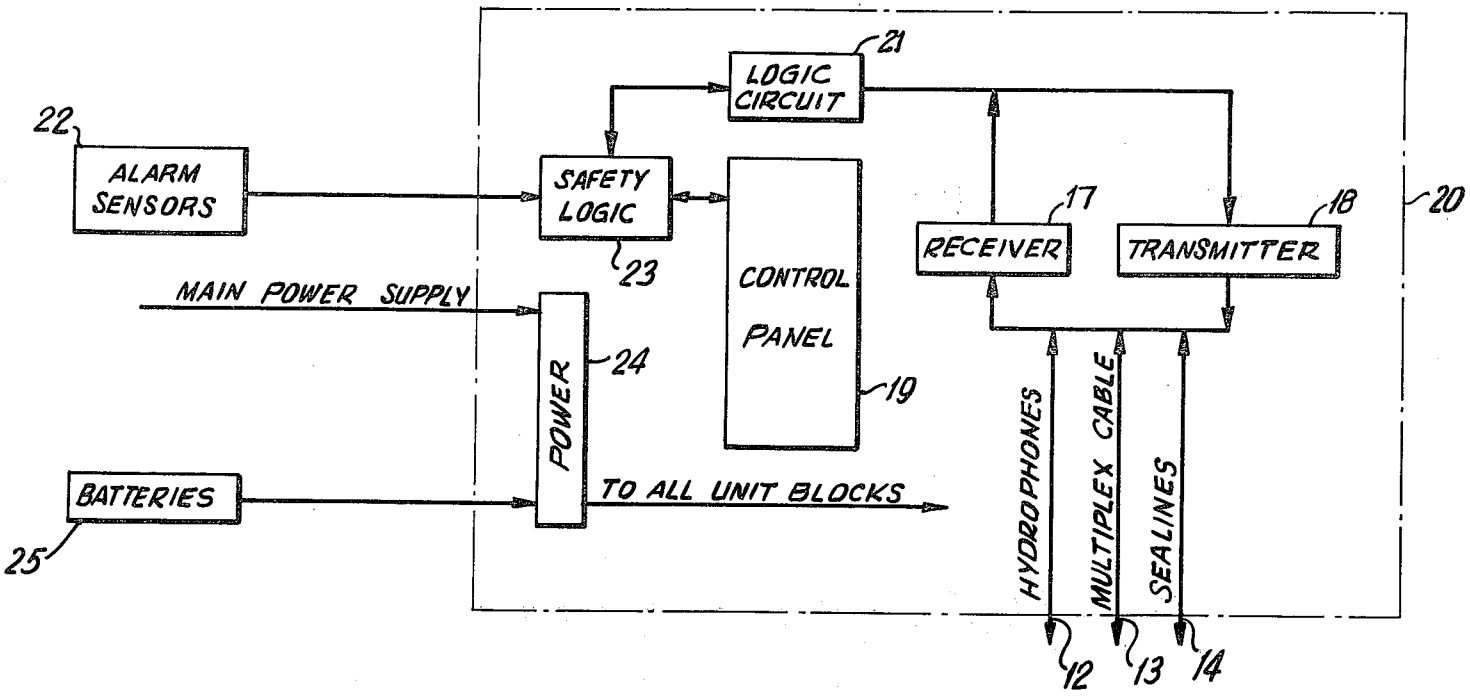
FIG. 3 is a block diagram of the surface electronic control unit.

Using push-buttons on the control panel 19, the operator, after selection of the underwater well-head to be operated, sends signals for operating the well valves 30 and requests data referring to the well-head or underwater unit conditions such as pressures, voltages etc. The signals, after passing through the electronic logic 21, are codified on the transmitter 18 and sent to the underwater unit shown in FIG. 3 by means of one of the three different transmission links 12, 13 or 14, preselected by the operator.

The batteries 25 provide electric power to the surface unit which can also be fed from the main power supply. The safety logic 23 receives possible alarms from the platform sensors 22 and automatically sends a signal to shut the underwater well-head if a particular condition arises.

Figure 2:
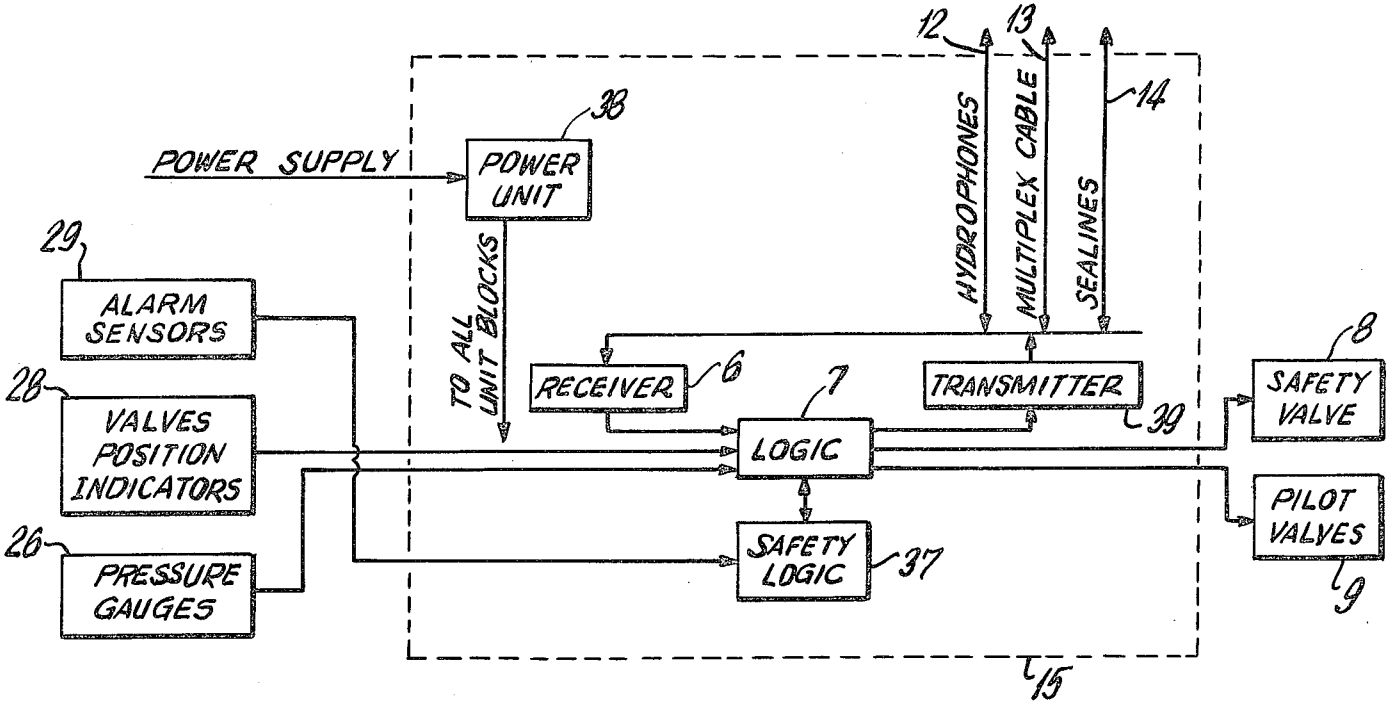
FIG. 2 is a general block diagram showing the underwater automated well-head system of the present invention.

Referring to FIG. 2, the control signals are received by the receiver 6 of the underwater electronic unit 15 and decodified. After passing through the electronic logic 7, the signals are fed to the solenoid pilot valves 9 and to the solenoid safety valve 8 of the hydraulic system in case the signal refers to valve operation or to well-head shut-up. On the other hand, if the signal refers to a data request, the logic circuit 7 interrogates the pressure gauges 26, the valve position indicators 28 or the battery voltage sensors. A safety logic 37 receives information from the alarm sensors 24 (installed on the well-head and on the underwater equipment) and it controls the solenoid safety valve 8 which operates the well-head shut-up in case of malfunction. A transmitter 39 feeds back the appropriate signals to the surface electronic unit 20. A nickel cadmium battery (not shown) provides power to the power unit 38 which distributes power to all blocks of the electronic unit 15.

Figure 4:
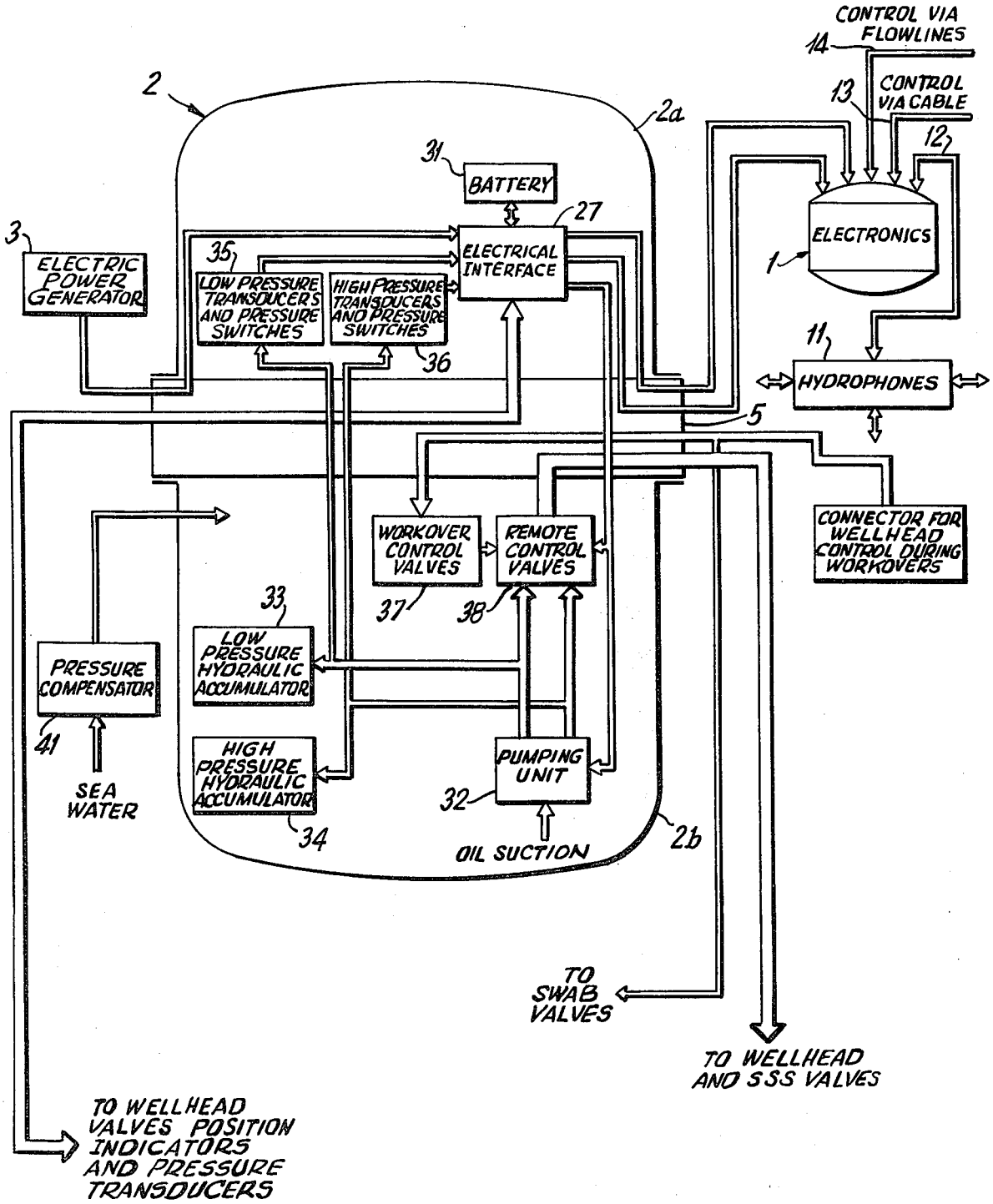
FIG. 4 is a more detailed schematic drawing of the underwater control system shown in FIG. 1.

In greater detail, the electronic circuitry of FIG. 2 is connected as shown in FIG. 4 to a container 2 which encloses the electric-hydraulic system. The container 2 is partititioned into two chambers 2*a* and 2*b* which are mutually connected by an interconnection plate 5 through which are formed all the passageways (for electric and hydraulic ducts) both between the two adjoining chambers 2*a* and 2*b* and towards the outside (for actuating the valve-operating members, for identifying their position, for reading the values of the pressure in the well-head and others).

In the top chamber 2*a*, under atmospheric pressure, is housed the electric interface unit 27 along with the storage batteries 31 for feeding both the electric hydraulic system and the electronic circuitry 15. The interface unit 27 fulfills the task of controlling the starting and the stopping of the electric motor (not shown) which actuates the hydraulic pump 32, on the basis of the indications given by the pressure-stats installed on the hydraulic accumulators 33 and 34 and of interconnecting all the electric signals coming from the hydraulic apparatus and from the apparatus mounted on the well-head with the electronic circuitry and vice versa.

In the lower chamber 2*b*, which is pressure-compensated and is thus under the pressure which corresponds to the depth at which the well-head has been installed, there are enclosed, in an oil-bath, the hydraulic installation and the aforementioned electric motor as well. The electric motor actuates a pump 32 which is intended only to load appropriate hydraulic accumulators 33 and 34.

The hydraulic accumulators 33 and 34 operate the actuators for the cutoff valves of the well at the instant of time at which operation is required and within the times which are provided for actuating such valves. The transfer of the operative hydraulic fluid to the utilization apparatus takes place by directional electromagnetic valves which are controlled by the control electronic circuitry. A radio-isotope generator 3 supplies the necessary electric power to the entire system via the storage batteries 31 installed in the top chamber 2*a* of the container 2.

For controlling the valves in the well-head 30 during the performance of operation from the surface, a cutoff block 4 is provided which permits, by appropriate hydraulically actuated valves, cutting off the electric hydraulic system which has been installed on the well-head 30.

The underwater control system 10 is shown in greater detail in FIG. 4. The container 1 for the electronics 15 is shown coupled to the transmission lines 12, 13 and 14 and also to the container 2 through plate 5. The container 1 is normally maintained at atmospheric pressure while the vessel 2 is divided into a first compartment 2*a* at atmospheric pressure and a second compartment 2*b* which is pressure compensated by means 41 and filled with hydraulic oil for the hydraulic system.

Basically, the submerged hydraulic unit is an oil wet-type hydraulic system and all components are contained in a cylindrical vessel constituting the mechanical support structure and the oil reservoir. The pressure compensation is obtained by means of a rubber bag accumulator which separates oil from seawater and allows variations of the oil volume in the reservoir during valve operations. The hydraulic unit is composed of two main circuits (high pressure for operating the subsurface safety valve, low pressure for operating the well-head valves) pressurized by pumps driven by the same electric motor. By means of pressure switches 35 and 36 and electro-valves 37 and 38, the electronic logic controls the charge of the high and low pressure accumulators. By activation of proper pilot electro-valves, hydraulic pressure is applied to the well-head valves.

In order to minimize the percentage of misunderstood signals ($10^{-6}$), the following transmission procedure is adopted: transmission of the signal from the control console 30; memorization of the signal and its retransmission to the control console 20; automatic comparison of the signal transmitted and received; transmission of the operating signal and, transmission from the underwater electronics of a signal which asserts that the operation has been performed.

The acoustic transmission system has been designed in order to avoid any interference (due to multipath and fading phenomena and to environmental noise) on the acoustic propagation. Two receivers and one transmitter, suitably located with respect to the sea bottom and sea surface, are used for the acoustic transmission both on the well-head and on the terminal platform.

In a typical embodiment, the surface control console 20 is able to control up to 15 well-heads 30 and with each well head, 7 well-head valves (with possible extension up to 11 valves). It is also possible to read up to 5 analog data such as pressure, temperatures etc. (with possible extension up to 7 data) to read the position of the well-head valves and to control the contemporaneous shut-off of all the well-heads in case of an emergency on the terminal platform. Finally, with the invention, it is possible to determine the cause of a well-head shut-off due to conditions of the well or equipment. The controls may operate at 115 V-60 Hz or 220 V-50 Hz or 24 V D.C.

It is understood that the above-described arrangements are merely illustrative examples of the application. Numerous other arrangements may be readily devised by those skilled in the art which will embody the principles of the invention and fall within the spirit and scope thereof.

We claim:

1. A control system for subsea well-heads comprising:

an above-water control system including a control panel arrangement for initiating predetermined commands to the well-heads, a logic circuit connected thereto to provide an output control signal designated by the control panel, a first receiver and a first transmitter activated by the output signal, a plurality of different transmission links coupled to the transmitter and receiver, at least one of which is utilized by the first transmitter and receiver, an underwater control unit including a second receiver to receive the output control signals and a second transmitter to provide feedback signals to the first receiver both coupled to the transmission links and a logic circuit connected to the second transmitter and the second receiver to direct the appropriate signals to the well-heads, and, an electric-hydraulic unit connected to the underwater control unit and the well-heads for receiving signals from the logic circuit and actuating the well-heads in accordance therewith comprising a container partitioned into an upper and lower chamber having an interconnection plate therebetween, the upper chamber including an electrical interface wherein the signals from the underwater control unit are converted into hydraulic signals, and the lower chamber including a hydraulic unit coupled to the well-heads, a hydraulic pump and a motor for driving said pump activated by the electrical interface.

2. A control system for subsea well heads according to claim 1, wherein said above the water control system:

(a) uses as transmission links acoustic transmission through sea water and electric transmission through a cable or along hydrocarbon flow ducts with a return of signals through the sea water;

(b) is provided with an alarm system for automatically closing the valves of the well-heads; and (c) can actuate a number of subsea well heads simultaneously in the case of alarm conditions.

3. A control system according to claim 1:

(a) wherein said container is formed of steel and said interconnection plate includes passageways for electric and hydraulic ducts between the two chambers and the surrounding environment;

(b) wherein said hydraulic unit, pump and motor are immersed in oil and said bottom chamber is pressure compensated; and (c) wherein said hydraulic unit has two circuits, a high-pressure and a low-pressure circuit fed by said pump.

4. A control system according to claim 1, wherein said system is constructed modularly for use on well heads of different types as regards the number of valves to be actuated and for calibration to different operative conditions.

5. A control system according to claim 1, wherein said system is adapted to use subsea sources of electric power of a low power throughout.

6. A control system for subsea well-heads in accordance with claim 1 wherein:

the transmission links comprise respectively an acoustic transmission link, a multiplex cable link and a subsea conduit link.

7. A control system for subsea well-heads in accordance with claim 6 further including:

a radio-isotope generator coupled to the system for supplying power thereto.

8. A control system for subsea well-heads in accordance with claim 1 wherein:

the upper chamber is maintained at atmospheric pressure and the lower chamber is maintained at the pressure corresponding to the sea depth.

9. A control system for subsea well-heads in accordance with claim 1 wherein:

the above-water control system includes a safety logic connected to the control panel and the logic circuit, and, alarm sensors connected to the safety logic to sense critical conditions at the well-heads and report said conditions to the control system.

* * * * *